US005360780A

United States Patent [19]

Okumura et al.

[11] Patent Number: 5,360,780

[45] Date of Patent: Nov. 1, 1994

[54] IMAGE-RECEIVING SHEET FOR THERMAL TRANSFER PRINTING WITH A LAYER CONTAINING AGGREGATES OF FINE PARTICLES OF THERMOPLASTIC RESIN

[75] Inventors: Yoshitaka Okumura, Kyoto; Hiromasa Kondo; Hiroshi Iwasaki, both of Ikoma; Soichi Saji, Osaka; Shinsuke Irii, Kobe, all of Japan

[73] Assignee: Kanzaki Paper Manufacturing Co., Ltd., Tokyo, Japan

[21] Appl. No.: 992,499

[22] Filed: Dec. 17, 1992

[30] Foreign Application Priority Data

Dec. 26, 1991 [JP] Japan ..... 3-344835
Mar. 31, 1992 [JP] Japan ..... 4-076447
Apr. 24, 1992 [JP] Japan ..... 4-107063

[51] Int. Cl.[5] ..... B41M 5/035; B41M 5/38

[52] U.S. Cl. ..... 503/227; 428/195; 428/206; 428/327; 428/913; 428/914

[58] Field of Search ..... 8/471; 428/195, 327, 428/913, 914, 206; 503/227

[56] References Cited

U.S. PATENT DOCUMENTS 5,133,820 7/1992 Katayama et al. ..... 156/234

*Primary Examiner*—B. Hamilton Hess
*Attorney, Agent, or Firm*—Wenderoth, Lind & Ponack

[57] ABSTRACT

An image-receiving sheet for thermal transfer printing comprising a substrate and an image-receiving layer disposed on said substrate, characterized in that said image-receiving layer contains thermoplastic resin fine particle aggregates. And an image-receiving sheet comprising a substrate, an intermediate layer disposed on said substrate, and an image-receiving layer disposed on said intermediate layer, characterized in that at least said intermediate layer contains thermoplastic resin fine particle aggregates.

20 Claims, No Drawings

IMAGE-RECEIVING SHEET FOR THERMAL TRANSFER PRINTING WITH A LAYER CONTAINING AGGREGATES OF FINE PARTICLES OF THERMOPLASTIC RESIN

BACKGROUND OF THE INVENTION

1. Field of the Invention

The present invention relates to an image-receiving sheet for thermal transfer printing which is provided with a layer containing aggregates of fine particles of a thermoplastic resin. More particularly, the present invention relates to an improvement in an image-receiving sheet for thermal transfer printing comprising an intermediate layer and an image-receiving layer being disposed in sequence on a substrate, in which at least either said intermediate layer or said image-receiving layer contains aggregates of fine particles of a thermoplastic resin.

2. Related Background Art

Thermal printing systems in which printed images are obtained upon reception of input signals are made up of a relatively simple apparatus and are inexpensive and low in noise. In view of this, they are increasingly utilized in various fields such as facsimiles, terminal printers for electronic computers, printers for measuring instruments, and the like.

As the recording medium to be used in these thermal printing systems, there has been generally used a so-called spontaneous developing heat sensitive paper having a recording layer capable of causing a physical or chemical change upon application of heat to provide color development. However, the spontaneous developing heat sensitive paper of the color developing type has disadvantages such that it is liable to undesirably cause color development during the fabrication process or during storage; and the images printed on the paper are poor in storage stability and they are apt to fade on contact with organic solvents or chemicals.

In order to improve the above situation, there has been proposed a printing system wherein a recording medium in which a coloring material such as a dye or colorant is utilized is used instead of the foregoing spontaneous developing heat sensitive paper, for example, as disclosed in Japanese Unexamined Patent Publication Sho. 51(1976)-15446. In the printing system disclosed in this publication, a colorant transfer sheet comprising a substrate such as a paper or polymer film and a colorant layer containing a coloring material (which is in a solid or semi-solid state at ordinally temperature) being formed on the substrate is firstly provided, this colorant transfer sheet and a image-receiving sheet are superposed so as to make the colorant layer of the colorant transfer sheet contacted with the image-receiving sheet, and the laminate is heated from the non-faced side of the former sheet by a heating means such as a thermal head to transfer the coloring material in the colorant layer of the colorant transfer sheet onto the image-receiving sheet upon application of electric signals provided by the heating means, whereby images corresponding to image information are recorded on the image-receiving sheet. In this printing system, the coloring material in the colorant layer of the colorant transfer sheet is caused to melt, evaporate or sublimate by the application of heat and transferred onto the image-receiving sheet, thereby forming a record image through adhesion, adsorption or reception of the coloring material on the image-receiving sheet. In view of this, this printing system has been evaluated as being advantageous from the viewpoint that there can be used an ordinary paper (wood free paper) as the image-receiving sheet. Further, as for this printing system, when a sublimable dye is used as the coloring material, there can be obtained a printed image excelling in tone reproduction. In order to develop this advantage in the full-color printing, various studies have been made.

However, there are disadvantages for the above printing system wherein an ordinary paper (wood free paper) is used as the image-receiving sheet such that sufficient dye-reception hardly occurs causing printed images which are poor in color density (optical density) and whose image is markedly discolored as time lapses.

In order to eliminate these problems, there has been proposed the use of an image-receiving sheet having an image-receiving layer containing a thermoplastic resin as the main constituent which is formed on a substrate as disclosed in Japanese Laid-open Patent Publication Sho. 57(1982)-107885, Japanese Laid-open Patent Publication Sho.60(1985)-38192 or U.S. Pat. No. 3,601,484.

The use of this image-receiving sheet is effective in somewhat improving the recording sensitivity and storageability. However, there still remains a problem in that when an ordinary paper (wood free paper) is used as the substrate, it is difficult to provide a desirable image-receiving layer containing a thermoplastic resin as the main constituent of uniform thickness with the paper and thus, the resulting image-receiving sheet unavoidably becomes such that is poor in recording sensitivity and provides undesirable images inferior in quality. In order to eliminate this problem, there has been proposed another image-receiving sheet having an intermediate layer comprising a thermoplastic resin which is disposed between a substrate and an image-receiving layer as disclosed in Japanese Laid-open Patent Publication Sho. 60(1985)-236794 or Japanese Laid-open Patent Publication Sho.61(1986)-144394. The image-receiving sheets disclosed in these publications are so designed that their image-receiving layer can be effectively contacted with the colorant layer of the colorant transfer sheet to prevent occurrence of negative phenomena such as air-gap upon printing and that they can exhibit an improved recording sensitivity and provide improved record images.

In addition, aiming at improving the quality of an image recorded, there has been proposed a further image-receiving sheet having an intermediate layer containing fine particles of a specific resin which is disposed between a substrate and an image-receiving layer as disclosed in Japanese Laid-open Patent Publication Sho.63(1988)-87286, Japanese Laid-open Patent Publication Sho.64(1989)-27996, Japanese Laid-open Patent Publication Hei.1(1989)-136784, and Japanese Laid-open Patent Publication Hei.2(1990)-139293. The image-receiving sheets disclosed in these publications are effective especially in obtaining desirable recorded images free of missing transfer portion. However, any of these image-receiving sheets is still accompanied with a disadvantage in that desirably uniform record images are hardly provided because the resin fine particles contained in the intermediate layer are undesirably varied.

In order to attain a desirable recording sensitivity for the image-receiving sheet resulting in providing a high quality recorded image while eliminating the above problem, there has been proposed to use synthetic papers or films as the substrate of the image-receiving sheet. This proposal is, however, not sufficient enough to solve the problem not only because the image-receiving sheet the substrate of which comprising such synthetic paper or film is liable to deform by heat applied upon recording but also because such synthetic paper and film are costly.

SUMMARY OF THE INVENTION

The present inventors made extensive studies in order to solve the foregoing problems in the conventional image-receiving sheet. Particularly, the present inventors made various studies mainly aiming at solving the problem of the foregoing image-receiving sheet provided with the intermediate layer containing fine particles of the specific resin while making use of the above-mentioned advantage of said image-receiving sheet. That is, the present inventors firstly provided aggregates of fine particles of a thermoplastic resin and prepared an image-receiving sheet comprising an intermediate layer incorporated with said aggregates and an image-receiving layer being disposed in this order on an ordinary paper (wood free paper) as the substrate. And as a result of evaluating the image-receiving sheet thus obtained with respect to various items required for an image-receiving sheet to be practically applicable, it was firstly found that the image-receiving sheet is satisfactory in recording sensitivity although the ordinary paper is used as the substrate and it can be mass-produced at a reduced cost. It was also found that the image-receiving sheet provides high quality record images excelling in resolution, clearness and optical density and which are not accompanied with any missing dots.

Similarly, the present inventors prepared an image-receiving sheet comprising an image-receiving layer incorporated with the above aggregates being disposed on an ordinary paper (wood free paper) as the substrate. The resultant image-receiving sheet was evaluated in the same manner as in the above. As a result, it was found that the image-receiving sheet is satisfactory in recording sensitivity although it is of a single-layered structure comprising the above image-receiving layer disposed on the ordinary paper and it can be mass-produced at a reduced cost. And this image-receiving sheet was found to provide high quality record images excelling in resolution, clearness and optical density and which are not accompanied with any missing dots.

The present invention has been accomplished based on the above findings.

An object of the present invention is to provide an improved image-receiving sheet for thermal transfer printing which is free of the foregoing problems found on the known image-receiving sheet and which is satisfactory in recording sensitivity even upon using an ordinary paper (wood free paper) as the substrate.

Another object of the present invention is to provide an improved image-receiving sheet for thermal transfer printing which provides high quality record images excelling in resolution and clearness with no accompaniment of missing dots.

DETAILED DESCRIPTION OF THE INVENTION

The present invention attains the above objects and it contemplates to provide an improved image-receiving sheet for thermal transfer printing for use in the printing system wherein a sublimable dye is thermally transferred.

An aspect of the present invention lies in an improved image-receiving sheet for thermal transfer printing which comprises a substrate and an image-receiving layer disposed on said substrate wherein said image-receiving layer is incorporated with aggregates of thermoplastic resin fine particles (hereinafter referred to as "thermoplastic resin fine particle aggregate").

Another aspect of the present invention lies in an improved image-receiving sheet for thermal transfer printing which comprises an intermediate layer and an image-receiving layer being disposed in this order on a substrate wherein at least either said intermediate layer or said image-receiving layer is incorporated with thermoplastic resin fine particle aggregate.

The term "thermoplastic resin fine particle aggregate" in the present invention means an aggregate in the fine particle-like form which comprises (a) negative charge-bearing resin fine particles and (b) positive charge-bearing resin fine particles being associated with each other by virtue of attraction of their surface charges wherein at least either the resin fine particles (a) or the resin fine particles (b) are of a thermoplastic resin.

The resin fine particles (a) and (b) constituting the aggregate include fine particles of a condensation resin such as polyester resin, polyamide resin, urea resin, melamine resin, etc., fine particles of a poly-addition resin such as polyurethane resin, epoxy resin, etc., and fine particles of a polymer resin such as vinyl resin, etc.

Each of the resin fine particles (a) and (b) may be obtained by an appropriate polymerization method such as an emulsion polymerization method or a suspension polymerization method wherein a given resin is produced in fine particle form. In order to make each of the resin fine particles (a) and (b) to be of a desirable particle size, it is possible to subject them to drying in liquid, wet granulation or freeze granulation. By this, each of the resin fine particles (a) and (b) are obtained in the form of a round shape, a round-bellied shape, a doughnut-like shape, a disk-like shape, or other appropriate shape. In any case, the distribution state of the resin particles are not always necessary to be uniform among the surface region and the inside region.

Alternatively, each of the resin fine particles (a) and (b) may be formed by utilizing a seed polymerization method or the like.

Each of the resin fine particles (a) and (b) may be in a capusulated form comprising an inside region composed of gaseous material, liquid material, wax or powdery material.

In any case, it is desired to use surface charge-bearing fine particles of a given resin in order to make it easier to obtain a desirable aggregate. In order to obtain negative or positive surface charge-bearing fine particles of a given resin, there can be employed a conventional method. As such method, there can be mentioned a method wherein as one of the components of the resin, a material having at least an anionic group selected from the group consisting of carboxyl group, sulfonic acid group, sulfuric acid group, phosphoric acid group or salts of these or a material having at least a primary, secondary or tertiary cationic group is used upon producing the resin fine particles (a) or the resin fine particles (b); a method wherein an ionic group is introduced through chemical bonding by a poylmer reaction upon producing the resin fine particles (a) or the resin fine particles (b); and a method wherein an anionic, cationic or amphoteric surfactant and/or ionic oligo soap are absorbed to the surfaces of the resin fine particles (a) or the resin fine particles (b). These methods can be selectively used depending upon the situation.

As above described, the aggregate may be formed by mixing the negative-charge bearing resin fine particles (a) and the positive charge-bearing resin fine particles (b) while stirring to cause association among the two kinds of resin fine particles by virtue of attraction of their surface charges. In order to facilitate the association, it is desired to appropriately adjust the pH value of each of the resin fine particles (a) and (b).

Alternatively, the aggregate may be also formed by a method wherein one of the resin fine particles (a) and the resin fine particles (b) are prepared by the emulsion polymerization method or suspension polymerization method in the presence of the other resin fine particles which have been prepared in advance.

The particle size of the aggregate may be properly controlled by adjusting the related conditions including the zeta potential of each of the two kinds of resin fine particles, the proportion of the resin fine particles (a) to the resin fine particiest(b) to be used, the shearing force upon mixing the two kinds of resin fine particles.

The resin fine particle aggregate used in the present invention is necessary to have a thermoplastic property. Thus, it is desired that the resin constituting at least one of the resin fine particles (a) and the resin fine particles (b) is a thermoplastic resin and the resin constituting the remaining resin fine particles is a resin having a softening point (a glass transition temperature) of higher than normal temperature, preferably 40° C. or above or a resin incapable of being softened at the temperature when processed.

The present inventors found the following facts through experiments. That is, (i) in the case of the thermal printing system using a colorant transfer sheet containing a thermally sublimable dye, when an image-receiving sheet having an image-receiving layer containing aggregates comprised of fine particles of polycondensation resin and/or polyaddition resin is used, the dye thermally transferred from the colorant transfer sheet onto the surface of the image-receiving sheet is well adhered at the surface of the image-receiving layer in a desirable state; (ii) the image-receiving Sheet having such image-receiving layer is hardly deteriorated even when stored over a long period of time; and (iii) this situation is improved when the image-receiving layer of the image-receiving sheet contains aggregates comprised of fine particles of polyester resin belonging to the polycondensation resin.

The present inventors found further facts through experiments that when (a) negative charge-bearing resin fine particles of a polyester resin having sulfonic acid salt group and (b) positive charge-bearing resin fine particles of a resin obtained through polymerization using vinyl monomer and the negative charge-bearing resin fine particles (a) and the positive charge-bearing fine particles (b) are mixed while stirring, the two kinds of resin fine particles are associated with each other by virtue of attraction of their surface charges to provide an aqueous dispersion comprising desirable aggregates being substantially uniform in particle size, and that both an image-receiving sheet having an image-receiving layer formed using said aqueous dispersion and an image-receiving sheet having an intermediate layer and an image-receiving layer in which at least the intermediate layer is formed using said aqueous dispersion are satisfactory in recording sensitivity, and they provide high quality record images excelling in resolution, clearness and optical density without any missing dots when they are used in the thermal printing system using a colorant transfer sheet containing a thermally sublimable dye. There was obtained a further finding such that each of the image-receiving sheets having record images thereon is hardly deteriorated even when stored over a long period of time.

Thus, a preferred embodiment of the image-receiving sheet for thermal transfer printing according to the present invention is characterized by comprising a substrate and an image-receiving layer disposed on said substrate wherein the image-receiving layer is formed of aggregates comprised of (a) negative charge-bearing resin fine particles of a polyester resin having sulfonic acid salt group and (b) positive charge-bearing resin fine particles of a resin obtained through polymerization using vinyl monomer.

Another preferred embodiment of the image-receiving sheet for thermal transfer printing according to the present invention is characterized by comprising a substrate, and an intermediate layer and an image-receiving layer disposed in sequence on said substrate wherein at least the intermediate layer is formed of aggregates comprised of (a) negative charge-bearing resin fine particles of a polyester resin having sulfonic acid salt group and (b) positive charge-bearing resin fine particles of a resin obtained through polymerization using vinyl monomer.

The negative charge-bearing resin fine particles (a) of the polyester resin having sulfonic acid group used in the present invention may be properly prepared by the conventional polycondensation technique. Particularly, for example, (A) one or more compounds selected from the group consisting of aromatic carboxylic acids, aliphatic carboxylic acids, anhydrides and lower alkyl esters of these organic carboxylic acids, which will be below mentioned, are subjected to condensation reaction with (B) one or more compounds selected from the group consisting of glycol compounds and compounds capable of serving as the glycol upon producing polyesters or copolyesters, which will be below mentioned, in the presence of (C) one or more condensation agents having a sulfonic acid salt group which will be below mentioned, wherein the product is obtained in fine particle form.

Specific examples of the compound (A) are aromatic carboxylic acids such as phthalic acid, terephthalic acid, isophthalic acid, 2,5-dimethyl terephthalic acid, naphthalenedicarboxylic acids, biphenyldicarboxylic acids, benzophenonetetracarboxylic acids, trimellitic acid, pyromellitic acid, trimesic acid, etc.; aliphatic carboxylic acids such as adipic acid, pimelic acid, suberic acid, azelaic acid, sebasic acid, cyclohexanedicarboxylic acid, etc.; anhydrides of these organic acids; and lower alkyl esters of these organic acids.

Specific examples of the compound (B) are ethylene glycol, propylene Glycol, 1,3-propanediol, 2,4-dimethyl-2-ethylhexane-1,3-diol, 2,2-dimethyl-1,3-propanediol, 2-ethyl-2-butyl-1,3-propanediol, 2-ethyl-2-isobutyl-1,3-propanediol, 1,3-butanediol, 1,4-butanediol, 1,5-pentanediol, 1,6-hexanediol, 2,2,4-trimethyl-1,6-hexanediol, 1,2-cyclohexanedimethanol, 1,3-cyclohexanedimethanol, 1,4-cyclohexanedimethanol, 2,2,4,4-tetramethyl-1,3-cyclobutanediol, 4,4'-thiodiphenol, 4,4'-methylenediphenol, 4,4'-(2-norbornylidene)diphenol, 4,4'-dihydroxybiphenyl, p-dihydroxybenzene, 4,4'-isopropylidenediphenol, 4,4'-isopropylidene-bis(2,6-dichlorophenol), 2,5-naphthalenediol, p-xylenediol, etc.

Specific examples of the condensation agent having a sulfonic acid salt Group (C) are sodium sulfophthalate, potassium sulfophthalate, sodium sulfoterephthalate, potassium sulfoterephthalate, sodium sulfoisophthalate, potassium sulfoisophthalate, sodium 3-sulfoadipate, sodium 2-sulfobisphenol A, potassium 3-sulfobisphenol A, sodium 3-sulfo-1,6-hexanediol, etc.; and lower alkyl esters of these compounds.

As for the polyester resin having sulfonic acid group capable of providing the negative charge-bearing fine particles (a), it is possible to use two or more kinds selected from those polyester resins obtained in the above manner.

Alternatively, it is possible to mix such polyester resin with one or more members selected from the group consisting of amino resins, epoxy resins and isocyanate resins in fused state or liquid state if necessary. In this case, it is possible to make these resins reacted with the above resins.

The positive charge-bearing resin fine particles (b) may be obtained in accordance with a method (hereinafter referred to as method I) wherein one or more positive charge-bearing vinyl monomers are subjected to addition polymerization in the presence of a polymerization initiator, if necessary with the use of an nonionic monomer; or a method (hereinafter referred to as method II) wherein an aqueous dispersion containing the negative charge-bearing polyester resin fine particles (a) (this resin fine particles will be hereinafter referred to as polyester resin fine particle) is provided, one or more positive charge-bearing vinyl monomers are subjected to polymerization reaction in the presence of the aqueous dispersion while using a polymerization initiator.

Of these two methods, the method II is the most advantageous since it enables to form the objective thermoplastic resin fine particle aggregate while producing the positive charge-bearing resin fine particles (b).

Specific examples of the positive charge-bearing vinyl monomer are 2-aminoethyl(metha)acrylate, 2-N,N-dimethylaminoethyl(metha)acrylate, 2-N,N-diethylaminoethyl(metha)acrylate, 2-N,N-dipropylamino(metha)acrylate, 2-N-tertbutylaminoethyl(metha)acrylate, 2-(4-morpholino)ethyl(metha)acrylate, 2-vinylpyridine, 4-vinylpyridine, aminostyrene, etc.

In any of the methods I and II, the polymerization conditions are properly adjusted by a conventional technique. Particularly, in the case of the method II, as for the proportion of the vinyl monomer to be used against the polyester resin fine particle, it should be properly determined depending upon the related factors including stability of the polyester resin fine particle. However, in general, it is desired to be adjusted such that the quantity of the ionic groups versus that of the ionic groups of the polyester resin fine particle is in the range of from 0.5 to 5.0 in termes of molar ratio.

There is not any particular restriction as for the polymerization initiator used upon polymerizing the viny monomer in any of the methods I and II.

However, preferred examples of the polymerization initiator are organic peroxides such as benzoyl peroxide, acetyl peroxide, etc.; azo compounds such as 2,2'-azobisisobutyronitrile, 2,2'-azobis(2,4-dimethylvaleronitrile), etc.; and inorganic peroxides such as persulfate, hydrogen peroxide, permanganate, etc. Other than these, there can be mentioned water-soluble redox series polymerization initiators comprising inorganic peroxide and sulfite, bisulfite, metasulfite, hydrosulfite, thiosulfite, ferrate or oxalic acid. Among these polymerization initiators, the water-soluble redox series polymerization initiators are the most desirable. As for the amount of the polymerization initiator used, it is generally made to be 0.05 to 5% by weight versus the amount of the vinyl monomer used.

Further, in the case of the method II, when the polymerization reaction of the vinyl monomer is conducted at a temperature higher than the glass transition temperature (Tg) (or the softening point) of the polyester resin fine particle present in the reaction system, spherical aggregates respectively comprising resin fine particles are afforded. On the other hand, when the polymerization reaction is conducted at a temperature lower than the Tg, porous aggregates respectively comprising resin fine particles. In the case where the polymerization reaction is conducted while using an appropriate solvent or an appropriate plasticizer for the polyester resin fine particle, the apparent Tg (or the softening point) of the polyester resin fine particle is reduced, and as a result, spherical aggregates respectively comprising resin fine particles are afforded even if the polymerization reaction is conducted at a relatively low temperature.

According to the method II, there are obtained thermoplastic resin fine particle aggregates comprising the negative charge-bearing polyester resin fine particles (a) and the positive charge-bearing resin fine particles (b) being associated with each other by virtue of attraction of their surface charges in the form of an aqueous dispersion comprising said aggregates being dispersed in water.

This aqueous dispersion may be used as it is upon forming the image-receiving layer or the intermediate layer of the image-receiving sheet according to the present invention.

Alternatively, the thermoplastic resin fine particle aggregates obtained according to the method II may be used in powdery form. In this case, the resultant aqueous dispersion is dried into powder by way of filtration, freeze-drying or spray-drying.

In order to obtain a thermoplastic resin fine particle aggregate using the positive charge-bearing resin fine particles (b) obtained in accordance with the method I, the positive charge-bearing resin fine particles (b) are mixed with the negative charge-bearing polyester resin fine particles (a) while stirring whereby the two kinds of resin fine particles are associated with each other by virtue of attraction of their surface charges. In this case, there is obtained an aqueous dispersion comprising the thermoplastic resin fine particle aggregates being dispersed in water.

In a preferred embodiment, the thermoplastic resin fine particle aggregate used at the time of forming the image-receiving layer or the intermediate layer of the image-receiving sheet according to the present invention is desired to be in the form of an aqueous suspension.

As for the thermoplastic resin fine particle aggregate used for the formation of the image-receiving layer or the intermediate layer, it is possible to use two or more kinds thereof.

The thermoplastic resin fine particle aggregate used in the present invention usually has a self-adhesion.

Therefore, the adhesion of the intermediate layer or the image-receiving layer with the substrate or other layer may be assured with the aid of heat and pressure treatments without using any binder. Thus, it is not always necessary to use a binder upon forming the image-receiving layer or the intermediate layer.

An important factor for the thermoplastic resin fine particle aggregate is that the aggregate should be of a mean particle size in the range of from 0.2 to 20 μm in order to insure the coating suitability and the feasibility of providing a smooth surface for the image-receiving layer or the intermediate layer. When the thermoplastic resin fine particle aggregate is of a mean particle size of less than 0.2 μm, it is difficult to make the image-receiving layer or the intermediate layer have a smooth surface. When the thermoplastic resin fine particle aggregate is of a mean particle size exceeding 20 μm, neither desirable coating suitability nor desirable surface smoothness cannot be attained.

Now in general, the formation of the image-receiving layer or the intermediate layer using the thermoplastic resin fine particle aggregate is performed in a manner that a coating composition comprising the thermoplastic resin fine particle aggregate-containing aqueous dispersion incorporated with a proper binder and/or a proper auxiliary is provided, and the coating composition is applied onto a substrate, followed by drying.

Examples of such binder are so-called coating binders. Specifically, there can be mentioned natural or semisynthetic high-molecular materials such as modified starch, carboxymethyl cellulose, hydroxyethyl cellulose, methyl cellulose, casein, gelatin, gum arabic, etc.; polyvinyl alcohol; polydienes such as isoprene, neoprene, polybutadiene, etc.; polyalkenes such as polybutene, polyisobutylene, polypropylene, polyethylene, etc.; vinyl polymers and vinyl copolymers of vinyl halide, vinyl acetate, styrene, (metha)acrylic acid, (metha)acrylic ester, (metha)acrylamide, methyl vinyl ether, etc.; polyesters; polyurethanes; polyamides; and synthetic rubber latexes of styrene-butadiene series, methylmethacrylate-butadiene-maleic acid series, etc.

As for the amount of the binder to be contained in the thermoplastic resin fine particle aggregate-containing aqueous dispersion, it is properly determined so that the effects of the thermoplastic resin fine particle aggregate is not hindered. In general, it is adjusted to be less than 500% by weight, or preferably in the range of from 0.01 to 200% by weight of the amount of the thermoplastic resin fine particle aggregates.

The auxiliary can include inorganic pigments such as calcium carbonate, talc, kaolin, titanium dioxide, aluminum hydroxide, zinc oxide, etc. and organic pigments such as urea-formaldehyde resin, melamine resin, guanamine resin, etc.

The coating composition may contain a relevant dye capable of serving to control the color shade and/or the whiteness of the layer. Further, the coating composition may contain a relevant ultraviolet ray absorber or/and a relevant antioxidant capable of serving to improve the stability of the layer. Further in addition, the coating composition may contain other auxiliaries such as dispersing agents, wetting agents, antifoaming agents, etc.

In the case of the image-receiving sheet having an intermediate layer comprised of the foregoing thermoplastic resin fine particle aggregate and an image-receiving layer disposed on said intermediate layer according to the present invention, the thickness of the intermediate layer is desired to be 0.5 μm or more, preferably in the range of from 1 to 50 μm. When the intermediate layer is of a thickness of less than 0.5 μm or of exceeding 50 μm, there is a tendency that desirable effects of the intermediate layer comprised of the thermoplastic resin fine particle aggregate will not be provided.

Pronounced effects are provided when smoothing treatment with the aid of heat and pressure using a supercalender or a cast drum is conducted after the formation of the intermediate layer or the image-receiving layer, wherein not only a desirable smoothness is provided at the surface of the layer comprised of the thermoplastic resin fine particle aggregate but also the recording sensitivity of the resulting image-receiving sheet is remarkably improved.

In the case of the image-receiving sheet having an intermediate layer comprised of the foregoing thermoplastic resin fine particle aggregate and an image-receiving layer disposed on said intermediate layer according to the present invention, there is not any particular restriction for the constituents of said image-receiving layer. For instance, in the case where the image-receiving sheet is one which is used in combination of a colorant transfer sheet provided with a layer containing a heat-melting solid ink, the image-receiving layer may comprise a conventional coated layer containing an oil absorptive material such as clay, calcined clay, kaolin, aluminum hydroxide, calcium carbonate, titanium dioxide, magnesium silicate, magnesium carbonate, white carbon, diatomaceous earth, etc. which is disclosed in Japanese Laid-open Patent Publication Sho.55(1980)-42824, Sho.57(1982)-182487, Sho.60(1985)-110488, Sho.60(1985)-110489, Sho.60(1985)-110490, Sho.60(1985)-110491 or Sho.60(1985)-192690.

Similarly, in the case where the image-receiving sheet is one which is used in combination with a colorant transfer sheet provided with a layer containing a thermally sublimable dye, the image-receiving layer may comprise a conventional coated layer containing a thermoplastic resin having a dyeing property (that is, a dyeing resin) selected from polymers and copolymers of vinyl monomer such as styrene, vinyl toluene, acrylate ester, methacrylate ester, acrylonitrile, vinyl chloride, vinyl acetate, etc., and condensation polymers such as polyester, polyamide, polycarbonate, polysulfone, epoxy resin, polyurethane, etc., and cellulose resin which is disclosed in Japanese Laid-open Patent publication Sho.57(1982)-107885, Sho.58(1983)-149048, Sho.59(1984)-165688, or Sho.61(1986)-27290.

In any case, the thickness of the image-receiving layer should be properly determined depending upon use purposes of the image-receiving sheet. However, in general, the thickness of the image-receiving layer is made such that the amount of a coating composition applied for the formation thereof is in the range of from 2 to 15 g/m$^2$ in terms of dry weight.

As above described, the present invention includes an image-receiving sheet provided with an image-receiving layer comprised of the foregoing thermoplastic resin fine particle aggregate. In this case, the image-receiving layer may be of a single layer structure comprising a layer comprised of the thermoplastic resin fine particle aggregate or a multi-layered structure having at least a layer comprised of the thermoplastic resin fine particle aggregate. The coating composition for the formation of the image-receiving layer in this case may contain one or more additives capable of serving to improve the suitability upon use in printers. Specific examples of such additive are antistatic agents, releasing agents, lublicants, etc.

The multi-layered image-receiving layer is generally designed to have a two-layered structure. In this case, one of the two layers is comprised of the thermoplastic resin fine particle aggregate as above described. The remaining layer may be a layer formed in the same manner as in the foregoing case of forming the image-receiving layer on the intermediate layer comprised of the thermoplastic resin fine particle aggregate.

In a preferred embodiment of the multi-layered image-receiving layer, the layer comprised of the thermoplastic resin fine particle aggregate is positioned as the outermost layer. In this case, the layer comprised of the thermoplastic resin fine particle aggregate is desired to contain an aqueous releasing agent and an aqueous cross-linking agent in order for the layer to have a desirable surface property. The image-receiving sheet provided with the multi-layered image-receiving layer thus structured excels in recording sensitivity and provides high quality record images excelling in resolution and clearness with no accompaniment without causing any heat-fusion with a colorant transfer sheet used. The image-receiving sheet excels in durability and it is hardly deteriorated even in the case where it is stored over a long period of time.

By the way, it is known that in the case where the image-receiving layer of an image-receiving sheet is formed of a thermoplastic resin as the main constituent aiming at improving the recording sensitivity and stability, the resulting image-receiving layer becomes to have a highly glossy surface because of the performance of the thermoplastic resin used. As the method capable of eliminating this problem, it is known to incorporate a large amount of one or more inorganic or organic pigments such as pulverized natural calcium carbonate, precipitated calcium carbonate, talc, clay, natural silic acids, synthetic silic acids, titanium dioxide, aluminum hydroxide, urea-formaldehyde resin, etc. However, problems entail in that the dyeing property of the image-receiving layer reduces in proportion to the amount of these pigments incorporated and the quality of an image recorded thereon reduces accordingly.

On the other hand, the thermoplastic resin fine particle aggregate used in the present invention is one that the particle size can be properly controlled as desired, and because of this, the glossiness of the surface of the image-receiving layer can be easily controlled as desired. In addition, in the case where the image-receiving layer is formed using a coating composition comprising the thermoplastic resin fine particle aggregate-containing aqueous dispersion, containing an aqueous releasing agent and an aqueous cross-linking agent, the resulting image-receiving sheet becomes such that stably provides high quality record images without causing heat-fusion with the colorant transfer sheet, and the image-receiving sheet having record images thereon is hardly deteriorated even in the case where it is stored over a long period of time.

As the aqueous releasing agent used in the present invention, there can be mentioned silicone series releasing agents and fluorine-containing releasing agents respectively of water-soluble type or water-dispersible type. Among these releasing agents, silicone series releasing agents are the most desirable. Specific examples of such silicone series releasing agent are alcohol-modified silicone oil, epoxypolyether-modified silicone oil, carboxy-modified silicone oil and the like having a reactive functional group are the most desirable. Commercially available examples of such modified silicone oil are SF-8421 and SF-8427 produced by Toray Silicone Kabushiki Kaisha, and X-51-789 produced by Shin-Etsu Silicone Kabushiki Kaisha. These modified silicone oils may be used either singly or in combination of two or more of them. As for the amount of the modified silicon oil to be contained, in the case where it is excessively small, there is a fear that a heat-fusion occurs between the image-receiving layer of the image-receiving sheet and the dye transfer layer of the colorant transfer sheet when they are in contact upon thermal transfer printing. And in the case where it is excessive, the resulting image-receiving layer becomes to have a undesirably slippery surface. In view of this, the amount of the modified silicon oil to be contained is desired to be preferably in the range of from 0.5 to 100% by weight or more preferably in the range of from 1 to 50% by weight versus the sum of the amount of the thermoplastic resin fine particle aggregate and the amount of other aqueous dyeing resin used for the formation of the image-receiving layer.

As the aqueous cross-linking agent used in the present invention, there can be mentioned water-soluble or water-dispersible cross-linking agents. Specific examples of such cross-linking agent are aldehyde series cross-linking agents, N-methylol series cross-linking agents, epoxy series cross-linking agents, aziridine series cross-linking agents, isocyanate series cross-linking agents, vinyl sulfone series cross-linking agents, and the like. These aqueous cross-linking agents may be used either singly or in combination of two or more of them. As for the amount of the aqueous cross-linking agent to be contained, a due care should be made so that desirable cross-linking effects are provided in the image-receiving layer to be formed. Specifically, the amount of the aqueous cross-linking agent to be contained is desired to be in the range of from 0.5 to 100% by weight or more preferably in the range of from 1 to 50% by weight versus the sum of the amount of the thermoplastic resin fine particle aggregate and the amount of other aqueous dyeing resin used for the formation of the image-receiving layer. The aqueous cross-linking agent is actuated to cause its cross-linking reaction by virtue of the action of heat during the drying process of the coating composition applied and/or during the finishing treatment. It is possible to use an appropriate catalyst capable of promoting the cross-linking reaction of the aqueous cross-linking agent.

Upon forming the image-receiving layer comprised of the thermoplastic resin fine particle aggregate in the manner as above described, it is possible to use, other than the thermoplastic resin fine particle aggregate, an aqueous dyeing resin comprising a water-soluble or water-dispersible thermoplastic resin such as vinyl polymers and copolymers of vinyl halide, vinyl acetate, styrene, (metha)acrylic ester, etc.; polyester resins; polyurethane resins; epoxy resins; acetate resins; polyamide resins; and the like. Specific commercially available products of such aqueous dyeing resin are PLASCOTE Z series products produced by Goo Chemical Industries Co., Ltd., POLYESTER WR series products produced by Nippon Synthetic Chemical Industry Co., Ltd., VYLONAL series products produced by Toyobo Co., Ltd., HYDRAN AP series products, HYDRAN HW series products and FINETEX ES series products produced by Dainippon Ink & Chemicals Inc., PES-RESIN series products produced by Takamatsu Oil &

Fats Co., Ltd., and EASTMAN WNT-SIZE produced by Eastman Kodac Company. These aqueous dyeing resins be used either singly or in combination of two or more of them.

Among these aqueous dyeing resins, those having a glass transition temperature preferably in the range of from 40° to 130° C. or more preferably in the range of from 60° to 110° C. are the most desirable. In the case where an aqueous dyeing resin having a glass transition temperature of less than 40° C. is used, a drawback-entails in that heat bleeding is caused upon subjecting the image-receiving sheet to thermal printing, resulting in providing record images which are poor in resolution. In the case where an aqueous dyeing resin having a glass transition temperature exceeding 150° C. is used, a drawback entails in that the recording sensitivity of the resulting image-receiving layer is reduced.

In the case of forming the image-receiving layer comprised of the thermoplastic resin fine particle aggregate while using the above aqueous dyeing resin, when the thermoplastic resin fine particle aggregate used is of a mean particle size of less than 0.1 μm, the glossiness of the surface of the resulting image-receiving layer cannot be controlled as desired. Similarly, when the thermoplastic resin fine particle aggregate used is of a mean particle size exceeding 40 μm, a drawback entails in that record images provided become poor in quality. In view of this, the thermoplastic resin fine particle aggregate used is desired to be of a mean particle size preferably in the range of from 0.1 to 15 μm or more preferably in the range of from 0.2 to 8 μm. In this case, there is afforded an image-receiving sheet provided with a desirable image-receiving layer which excels in recording sensitivity and provides high quality record images.

In the case of forming the image-receiving layer comprised of the thermoplastic resin fine particle aggregate while using the above aqueous dyeing resin, the glossiness of the surface of the resulting image-receiving layer may be properly controlled as desired by adjusting the ratio of the aqueous dyeing resin to be mixed with the thermoplastic resin fine particle aggregate used upon forming the image-receiving layer and/or the conditions upon drying the coating composition applied for the formation of the image-receiving layer. Particularly, as for the ratio of the amount of the thermoplastic resin fine particle aggregate versus the amount of the aqueous dyeing resin, it is desired to be preferably in the range of from 1/20 to 10/1 or more preferably in the range of from 1/9 to 2/8 in terms of weight ratio.

In the case of forming the image-receiving layer comprised of the thermoplastic resin fine particle aggregate while using the above aqueous dyeing resin, the amount of the coating composition applied for the formation of the image-receiving layer should be properly determined depending upon the use purpose of the image-receiving sheet obtained. However, in general, it is desired to be in the range of from 1 to 15 g/m$^2$ in terms of dry weight.

As the substrate of the image-receiving sheet according to the present invention, an ordinary paper (that is, a wood free paper), a synthetic paper or a polymer film can be selectively used. Of these, the wood free paper is the most desirable since it excels not only in heat resisting property but also in other thermal properties.

The wood free paper used in the present invention includes papers manufactured under acidic conditions, neutral conditions or alkaline conditions which are comprised of mainly of cellulose pulp and added with a wet strength agent, sizing agent, fixer, filler such as inorganic or organic pigment, etc.

The wood free paper also includes those papers manufactured by size-pressing the above papers with the use of oxidized starch or the like, and other papers having an improved surface physical property manufactured by providing the above papers with a precoat layer containing a pigment such as clay as the main constituent.

Other than those above mentioned, a No. 1 grade coated paper, a coated paper or a cast coated paper can be suitably used as the substrate of the image-receiving sheet according to the present invention.

These wood free papers may be applied with an anchor coat, a thin film member, a foamed thin film or a synthetic paper to their surface in order to improve their adhesion, barrier properties, surface smoothness or opacifying properties.

The image-receiving sheet thus provided in the present invention excels in recording sensitivity and stably provides high quality record images excelling in resolution, clearness and optical density and which are not accompanied with any missing dots. Further, the image-receiving sheet having such high quality images recorded thereon are hardly deteriorated even in the case where it is stored over a long period of time. The reason why the image-receiving sheet of the present invention provides these significant effects are not clear enough at the present time, but it is considered to be due to the performance of the thermoplastic resin fine particle aggregate that the aggregate exhibits its characteristics upon performing thermal transfer printing to uniformly transmit heat from the recording head and to ensure the contact of the image-receiving layer of the image-receiving sheet with the dye transfer layer of the colorant transfer sheet.

The image-receiving sheet for thermal transfer printing to be provided according to the present invention is usable not only in the thermal transfer printing system wherein contact heat caused, for example, by a heating plate or thermal head of thermal printing unit is utilized but also in other thermal printing systems wherein indirect contact heat with the use of infrared lamp, YAG laser or carbon oxide gas laser is utilized.

PREFERRED EMBODIMENTS OF THE INVENTION

The advantages of the present invention will be described in more detail by reference to the following examples, which are provided here for illustrative purposes only, and are not intended to limit the scope of the present invention.

In the following examples and comparative examples, unless otherwise indicated, parts and % signify parts by weight and % by weight respectively.

EXAMPLES 1 TO 12

(1) Preparation of 12 kinds of thermoplastic resin fine particle aggregate-containing aqueous dispersions

Preparation of Aqueous Dispersion Containing Resin Fine Particles 94 parts of dimethylterephthalate, 95 parts of dimethylisoterephthalate, 89 parts of ethylene glycol, 80 parts of neopentyl glycol, and 0.1 part of tetrabuthoxy titanate were introduced into a reaction vessel provided with an agitator, a temperature gauge and a $N_2$ gas blowing equipment, wherein the materials introduced were subjected to ester exchange reaction at a temperature of 190° to 220° C. for 3 hours while stirring in a gaseous atmosphere comprising $N_2$ gas. After 6.7 parts of 5-sodium sulfoisophthalate having added, the resultant was subjected to condensation reaction by maintaining the resultant at a temperature of 220° to 250 ° C. for an hour under reduced pressure (1 mmHg), whereby sulfonate group-containing polyester resin (Tg:59° C., the sulfonate group content: 0.12 mole equivalent/1 Kg) was obtained.

34 parts of the polyester resin obtained in the above was dissolved in 10 parts of butyl cellosolve at 110° C., followed adding 56 parts of water maintained at 80° C., whereby an aqueous dispersion was obtained. The resultant aqueous dispersion was introduced into a distillation flask, wherein it was distilled until the fraction temperature reached 100° C., followed by cooling, and 25 parts of deionized water was added, whereby an aqueous dispersion containing resin fine particles of 0.08 μm in mean particle size was obtained.

Preparation of Aqueous Dispersion Containing Resin Fine Particle Aggregate

Using a reaction vessel provided with an agitator, a temperature gauge and a packed column, the aqueous dispersion obtained in the above and dimethylaminoethylmethacrylate were subjected to polymerization while dropwise adding a 0.2% aqueous solution of ammonium persulfate to the reaction system. This procedure was repeated in 12 different ways as Examples 1 to 12 wherein the polymerization conditions (molar ratio of the positive charge-bearing resin/the negative charge-bearing resin, polymerization temperature and aging period) were made different in each case as shown in each of the columns of Examples 1 to 12 of Table 1.

Thus, there were obtained 12 kinds of aqueous dispersions respectively containing thermoplastic resin fine particle aggregates with a different mean particle size and a different particle size uniformity coefficient shown in each of the columns of Examples 1 to 12 of Table 1. The particle size uniformity coefficient (%) shown in Table 1 means a proportion (%) of the aggregate particles in the range of from 0.5 D to 2 D, with D being a mean particle size.

(2) Formation of an intermediate layer using each of the 12 thermoplastic resin fine particle aggregate-containing aqueous dispersions Using each of the 12 thermoplastic resin fine particle aggregate-containing aqueous dispersions, there was formed an intermediate layer on a substrate in the following manner.

In each case, a coating composition (solid content: 30%) was prepared by mixing 500 parts of a 10% aqueous solution of polyvinyl alcohol and 1 part of polystyrene-acryl copolymer latex with 100 parts of the thermoplastic resin fine particle aggregate-containing aqueous dispersion on the basis of the solid material. The coating composition thus obtained was applied onto a wood free paper of 81 g/m$^2$ and 80 μm in thickness in an amount to be 10 g/m$^2$ when dried to form a liquid coat comprising said coating composition on said paper by means of a wire bar coater, followed by air-drying, to thereby form an intermediate layer.

Thus, there were obtained 12 kinds of works in process respectively having an intermediate layer comprised of the thermoplastic resin fine particle aggregate having a different mean particle size.

(3) Formation of a two-layered image-receiving layer on the intermediate layer of each of the 12 works in process An image-receiving layer comprising (a) a first layer and (b) a second layer was formed on the intermediate layer of each of the 12 works in process in the following manner.

(i) Formation of first layer (a):

A coating composition comprising aqueous polyester resin (solid content:34%) was firstly provided. The coating composition was applied onto the surface of the intermediate layer in an amount to be 8 g/m$^2$ when dried to form a liquid coat comprising said coating composition on said intermediate layer by means of a wire bar coater, followed by air-drying, to thereby form a first layer (a). The resultant was graduated at a linear pressure of 200 kg/cm by means of a supercalender provided with a metal roll having a mirror ground surface and an elastic roll.

(ii) Formation of second layer (b):

100 parts of saturated polyester resin, 1.5 parts of amino-modified silicone oil and 1.5 parts of epoxy-modified silicone oil were dissolved in a combined solvent comprising methyl ethyl ketone/toluene (weight ratio=1: 1) to obtain a coating composition of 15% in solid content. The coating composition was applied onto the surface of the first layer (a) in an amount to be 1.5 g/m$^2$ when dried to form a liquid coat comprising said coating composition on the first layer (a) by means of a wire bar coater, followed by air-drying. The resultant was then subjected to curing treatment at 100° C. for 2 minutes to thereby form a second layer (b).

Thus, there were obtained 12 kinds of image-receiving sheets.

EVALUATION

The image-receiving sheets obtained in Examples 1 to 12 were evaluated.

In the evaluation of each of the image-receiving sheets, there was used a thermal dye-transfer sheet which was prepared as below described.

That is, 4 parts of a blue thermally sublimable disperse dye (trademark name: KST-B-714, produced by Nippon Kayaku Co., Ltd.) and 4 parts of polyvinyl butyral resin (trademark name: S-lec BX-1, produced by Sekisui Chemical Co., Ltd.) were dissolved in a combined solvent comprising methyl ethyl ketone/toluene (weight ratio=1: 1) to obtain an ink composition. The ink composition thus obtained was applied onto a 6 um thick polyester film whose reverse side having been applied with heat-resisting treatment in an amount to be 1 g/m$^2$ when dried by means of a wire bar coater, followed by air-drying, to thereby obtain a thermal dye-transfer sheet having a thermal dye-transfer layer.

The thermal dye-transfer sheet thus obtained was superposed on the image-receiving sheet sample to be evaluated, followed by printing with the application of heat through a thermal head, wherein a voltage was impressed under conditions of 12 V in voltage and 4 to 16 msec. in pulse width, for evaluating the recording sensitivity of the image-receiving sheet sample and the quality of an image printed.

These evaluations were conducted in the following manners.

Evaluation of the Recording Sensitivity

Using a Macbeth Reflection Densitometer (trademark name: RD-914, produced by Macbeth Corp., U.S.A.), the optical density of an image recorded with each of 4, 7, 10, 13 and 16 msec. in pulse width was measured with respect to each of the image-receiving sheet samples.

The measured results are collectively shown in Table 1.

Evaluation of the Quality of an Image Recorded

This evaluation was conducted with respect to resolution, occurrence of missing dot, and image uniformity as follows.

Resolution

This evaluation was conducted by observing the situation of dot reproduction as to an image of a maximum optical density recorded with a pulse width of 16 msec. by eyes with the use of a magnifier of a 25 times magnification on the basis of the following criteria with respect to each of the image-receiving sheet samples.

A: excellent dot reproduction
B: fair dot reproduction
C: somewhat inferior dot reproduction, problematic in practical use
D: inferior dot reproduction, not acceptable in practical use Occurrence of Missing Dot This evaluation was conducted by observing the situation of occurrence of a missing dot as to a highlight image recorded with a pulse width of 7 msec. by eyes with the use of a magnifier with a 25 times magnification on the basis of the following criteria with respect to each of the image-receiving sheet samples.

A: absolutely no occurrence of missing dot and excellent dot reproduction
B: little occurrence of missing dot, but practically acceptable
C: distinguishable occurrence of missing dot and problematic in practical use
D: significant occurrence of missing dot and not acceptable in practical use Image Uniformity This evaluation was conducted by observing the situation of uneven density as to a highlight image recorded with a pulse width of 7 msec. by eyes on the basis of the following criteria with respect to each of the image-receiving sheet samples.

A: absolutely free of uneven density and excellent in image uniformity
B: substantially free of uneven density and fair in image uniformity
C: distinguishable uneven density and problematic in practical use
D: significant uneven density and not acceptable in practical use The results thus evaluated are collectively shown in Table 1.

COMPARATIVE EXAMPLE 1

The procedures of Example 1 were repeated, except that the polymerization conditions (molar ratio of the positive charge-bearing resin/the negative charge-bearing resin, polymerization temperature and aging period) upon obtaining the aqueous dispersion containing thermoplastic resin fine particle aggregate were changed to those shown in the column of Comparative Example 1 of Table 1 to obtain an aqueous dispersion containing thermoplastic resin fine particle aggregates with a mean particle size of 50.0 μm, to thereby obtain a comparative image-receiving sheet.

As for the resultant comparative image-receiving sheet, the recording sensitivity and the quality of an image obtained were evaluated in the same manner as in Examples 1 to 12. The evaluated results obtained are shown in Table 1.

COMPARATIVE EXAMPLE 2

The procedures of Example 1 were repeated, except that the aqueous dispersion containing resin fine particles of 0.08 μm in mean particle size obtained in the step of the preparation of aqueous dispersion containing resin fine particles was used as it was instead of the thermoplastic resin fine particle aggregate-containing aqueous dispersion, to thereby obtain a comparative image-receiving sheet.

As for the resultant comparative image-receiving sheet, the recording sensitivity and the quality of an image obtained were evaluated in the same manner as in Examples 1 to 12. The evaluated results obtained are shown in Table 1.

COMPARATIVE EXAMPLE 3

The procedures of Example 1 were repeated, except that the intermediate layer was formed using a coating composition having a solid content of 40% and composed of 250 parts of thermosetting benzoguanamine resin fine particles of 2 μm in mean particle size (trademark name: EPOSTAR-EPS-MS, produced by Nippon Shokubai Kagaku Kogyo Co., Ltd.), 600 parts of polyolefin resin fine particles of 5 μm in mean particle size (softening point: 54° C., solid content:40%, particle size uniformity coefficient:less than 50%)(trademark name: CHEMIPEARL A-100, produced by Mitsui Petrochemical Industries Co., Ltd.) and 150 parts of styrene-butadiene copolymer latex (solid content:48%)(trademark name: L-1690, produced by Asahi Chemical Industry Co., Ltd), to thereby obtain a comparative image-receiving sheet.

As for the resultant comparative image-receiving sheet, the recording sensitivity and the quality of an image obtained were evaluated in the same manner as in Examples 1 to 12. The evaluated results obtained are shown in Table 1.

COMPARATIVE EXAMPLE 4

The procedures of Example 1 were repeated, except that no intermediate layer was formed, to thereby obtain a comparative image-receiving sheet.

As for the resultant comparative image-receiving sheet, the recording sensitivity and the quality of an image obtained were evaluated in the same manner as in Examples 1 to 12. The evaluated results obtained are shown in Table 1.

EXAMPLES 13 TO 24

There were prepared 12 image-receiving sheets as Examples 13 to 24 respectively having an intermediate layer and a two-layered image-receiving layer, using one of the 12 thermoplastic resin fine particle aggregate-containing aqueous dispersions obtained in Examples 1 to 12 in each case.

Each of the 12 image-receiving sheets was prepared in the following manner.

(1) Formation of Intermediate Layer 20 parts of a thermosetting resin (trademark name: EPOSTER MS, produced by Nippon Shokubai Kagaku Kogyo Co., Ltd.) was dispersed into 100 parts of a 10% aqueous solution of polyvinyl alcohol (trademark name: PVA 205, produced by Kuraray Co., Ltd.) to obtain a coating composition. The coating composition thus obtained was applied onto a wood free paper of 85 g/m$^2$ in an amount to be 10 g/m$^2$ when dried by means of a wire bar coater, followed by air-drying, to thereby form an intermediate layer on the wood free paper. In this way, there were obtained 12 works in process respectively having an intermediate layer.

(2) Formation of Image-receiving Layer

An image-receiving layer comprising (a) a first layer and (b) a second layer was formed on the intermediate layer of each of the 12 works in process obtained in the above in the following manner.

(i) Formation of first layer (a):

A coating composition was prepared by mixing 100 parts of a polyester resin (trademark name:VYLONAL MD-1200 (solid content:34%), produced by Toyobo Co., Ltd.) with 100 parts (on the basis of the solid material) of one of the 12 thermoplastic resin fine particle aggregate-containing aqueous dispersions obtained in Examples 1 to 12. The coating composition thus obtained was applied onto the intermediate layer of one of the 12 works in process in an amount to be 8 g/m$^2$ when dried to form a liquid coat comprising said coating composition by means of a wire bar coater, followed by air-drying. The resultant was graduated at a linear pressure of 200 kg/cm by means of a supercalender provided with a metal roll having mirror ground surface and an elastic roll. Thus, there were obtained 12 kinds of works in process respectively having a first layer (a) disposed on the intermediate layer.

(ii) Formation of second layer (b)

100 parts of saturated polyester resin, 1.5 parts of amino-modified silicone oil and 1.5 parts of epoxy-modified silicone oil were dissolved in a combined solvent comprising methyl ethyl ketone/toluene (weight ratio=1: 1) to obtain a coating composition of 15% in solid content. The coating composition was applied onto the surface of the first layer (a) of each of the 12 works in process in an amount to be 1.5 g/m$^2$ when dried to form a liquid coat comprising said coating composition on the first layer (a) by means of a wire bar coater, followed by air-drying. The resultant was then subjected to curing treatment at 100° C. for 2 minutes to thereby form a second layer (b).

Thus, there were obtained 12 kinds of image-receiving sheets.

Each of the 12 image-receiving sheets was evaluate with respect to its recording sensitivity of the image-receiving sheet and the quality of an image printed in the same manner as in Examples 1 to 12.

The evaluated results obtained are collectively shown in Table 2.

COMPARATIVE EXAMPLE 5

The procedures of Example 13 were repeated, except that the first layer (a) was formed using a coating composition composed of 100 parts (on the basis of the solid material) of the thermoplastic resin fine particle aggregate-containing aqueous dispersion obtained in Comparative Example 1 and 100. parts of a polyester resin (trademark name: VYLONAL MD-1200 (solid content:34%), produced by Toyobo Co., Ltd.), to thereby obtain a comparative image-receiving sheet having a two-layered image-receiving layer.

The resultant comparative image-receiving sheet was evaluate with respect to its recording sensitivity and the quality of an image printed in the same manner as in Examples 1 to 12.

The evaluated results obtained are shown in Table 2.

COMPARATIVE EXAMPLE 6

The procedures of Example 13 were repeated, except that the aqueous dispersion containing resin fine particles of 0.08 μm in mean particle size obtained in the step of the preparation of aqueous dispersion containing resin fine particles in Examples 1 to 12 was used as it was instead of the thermoplastic resin fine particle aggregate-containing aqueous dispersion upon forming the first layer (a), to thereby obtain a comparative image-receiving sheet having a two-layered image-receiving layer.

The resultant comparative image-receiving sheet was evaluate with respect to its recording sensitivity and the quality of an image printed in the same manner as in Examples 1 to 12.

The evaluated results obtained are shown in Table 2.

Examples 25 to 29 and Comparative Example 7

EXAMPLES 25 TO 29

There were prepared 5 kinds of image-receiving sheets as Examples 25 to 29 respectively having an intermediate layer, a barrier layer and a single image-receiving layer.

(1) Formation of Intermediate Layer

There were firstly provided 5 wood free papers of 85 g/m$^2$.

An intermediate layer was formed on each of the 5 wood free papers in the following manner. That is, a coating composition (solid content:35%) for the formation of the intermediate layer was prepared by mixing 87 parts of a polyolefin-containing dispersion (trademark name: CHEMIPERL A-100, produced by Mitsui Petrochemical Industries, Ltd.), 10 parts of polystyrene-acryl copolymer latex (trademark name:SEBIAN A-4720, produced by Daicel Chemical Industries Ltd.) and 3 parts of polyvinyl alcohol (trademark name: PVA-205, produced by Kuraray Co., Ltd.) while stirring. The coating composition thus obtained was applied onto each of the 5 wood free paper in an amount to be 15 g/m$^2$ when dried to form a liquid coat comprising said coating composition by means of a wire bar coater, followed by air-drying, to form an intermediate layer on each of the 5 wood free papers.

(2) Formation of Barrier Layer

A polyester resin-containing aqueous dispersion (trademark name:WNT-SIZE (a dispersion of 25% in nonvolatile matter content), produced by Eastman Chemical Company) was applied onto the intermediate layer of each of the 5 works in process obtained in the above in an amount to be 2 g/m$^2$ when dried to form a liquid coat by means a wire bar coater, followed by air-drying, to form a barrier layer on the intermediate layer of each of the 5 works in process.

Each of the 5 resultants was graduated at a linear pressure of 200 kg/cm by means of a supercalender provided with a metal roll having mirror ground surface and an elastic roll.

Thus, there were obtained 5 works in process respectively having an intermediate layer and a barrier layer.

(3) Formation of Image-receiving Layer

An image-receiving layer was formed on each of the 5 resultants in the above step (2) in the following manner.

(i) Using the aqueous dispersion containing resin fine particles of 0.08 μm in mean particle size obtained in Examples 1 to 12, there were prepared 5 kinds of thermoplastic resin fine particle aggregate-containing aqueous dispersions by repeating the procedures for the preparation of aqueous dispersion containing resin fine particle aggregate in Example 1, except for changing the conditions for polymerizing the aqueous dispersion containing resin fine particles of 0.08 μm in mean particle size and the diethylaminoethylmethacrylate to those shown in each of the columns of Examples 25 to 29 of Table 3.

(ii) Using each of the 5 thermoplastic resin fine particle aggregate-containing aqueous dispersions, there were prepared 5 kinds of coating compositions in the following manner.

That is, in each case, a coating composition was prepared by adding 2 parts of 28% aqueous ammonia to 80 parts of a polyester resin-containing aqueous dispersion (trademark name:PES-RESIN A-810 (a dispersion of 30% in nonvolatile matter content), produced by Takamatsu Oil & Fats Co., Ltd.) to a mixture, admixing this mixture with 2 parts of an aziridine series cross-linking agent (trademark name:CHEMITITE PZ-33 (100% active gredient), produced by Nippon Shokubai Kagaku Kogyo Co., Ltd.) and 5 parts of a carboxy-modified silicone microemulsion (trademark name: X-51-789 (a 20% aqueous dispersion), produced by Shin-Etsu Chemical Co., Ltd.), and adding 20 parts of one of the 5 thermoplastic resin fine particle aggregate-containing aqueous dispersions to the resultant while stirring.

Thus, there were obtained 5 kinds of coating compositions.

(iii) On the barrier layer of each of the above 5 resultants obtained in the above step (2), there was formed an image-receiving layer by applying one of the 5 coating compositions in an amount to be 5 g/m$^2$ when dried to form a liquid coat by means of a wire bar coater, followed by air-drying.

Thus, there were obtained 5 image-receiving sheets respectively having an intermediate layer, a barrier layer and an image-receiving layer.

COMPARATIVE EXAMPLE 7

The procedures of Example 25 were repeated, except that the thermoplastic resin fine particle aggregate-containing aqueous dispersion for the formation of the image-receiving layer was replaced by an aqueous dispersion Containing polystyrene resin fine particles with a mean particle size of 0.3 μm (trademark name: GRANDOL PP-1000 (48% aqueous dispersion, Tg:104° C.), produced by Dainippon Ink & Chemicals Inc.), to thereby obtain a comparative image-receiving sheet having a single image-receiving layer.

EVALUATION

The image-receiving sheets obtained in Examples 25 to 29 and the comparative image-receiving sheet obtained in Comparative Example 7 were evaluated.

In the evaluation of each of the image-receiving sheets, there was used a thermal dye-transfer sheet which was prepared as below described.

That is, 1 part of a red thermally sublimable disperse dye (trademark name:DISPERSE RED 60, produced by Nippon Kayaku Co., Ltd.), 1.5 parts of ethyl cellulose, 10 parts of isopropyl alcohol and 5 parts of ethanol were introduced into a sand mill, wherein they were well mixed while grinding the solid materials, to obtain an ink dispersion containing fine particles with a mean particle size of 1 μm. The ink dispersion was applied onto a 6 μm thick polyester film whose reverse side having been applied with heat-resisting treatment in an amount to be 1 g/m$^2$ when dried by means of a gravure printing technique, followed by air-drying, to thereby obtain a thermal dye-transfer sheet having a thermal dye-transfer layer.

The thermal dye-transfer sheet thus obtained was superposed on the image-receiving sheet sample to be evaluated, followed by printing with the application of heat through a thermal head, wherein a voltage was impressed under conditions of 12 V in voltage and 4 to 16 msec. in pulse width, for evaluating the glossiness of the surface of the image-receiving sheet sample, the recording sensitivity of the image-receiving sheet sample and the quality of an image printed.

These evaluations were conducted in the following manners.

Evaluation of the Glossiness

The glossiness of the surface of each of the image-receiving sheet samples was measured by means of a glossmeter (trademark name: GM-26D, produced by Murakami Shikisai Gijutsu Kenkyusho) at a measuring angle of 45°.

The measured results obtained are collectively shown in Table 4.

Evaluation of the Recording Sensitivity

Using a Macbeth Reflection Densitometer (trademark name:RD-914, produced by Macbeth Corp., U.S.A.), the optical density of an image recorded with each of 4, 7, 10, 13 and 16 msec. in pulse width was measured with respect to each of the image-receiving sheet samples.

The measured results obtained are collectively shown in Table 1.

Evaluation of the Quality of an Image Recorded

This evaluation was conducted with respect to resolution, occurrence of missing dot, and image uniformity in the same manner as in Examples 1 to 12.

The results thus evaluated are collectively shown in Table 4.

From the results shown in Tables 1, 2 and 4, it is understood that any of the image-receiving sheets obtained in Examples 1 to 29 of the present invention excels in recording sensitivity and provides a high quality, extremely clear record image excelling in optical density. Particularly, from the results shown in Table 4, it is understood that any of the image-receiving sheets having a sole layer comprising the image-receiving layer comprised of the specific thermoplastic resin fine particle aggregate obtained in Examples 25 to 29 of the present invention excels in surface natural glossiness, excels in recording sensitivity and provides a high quality, extremely clear record image excelling in optical density.

TABLE 1

| | thermoplastic resin fine particle aggregate | | | | | evaluation | | | | | | | |
|---|---|---|---|---|---|---|---|---|---|---|---|---|---|
| | | | | | | | | | | | image quality | | |
| | | | | | | optical density of image | | | | | | | |
| | molar ratio* | polymerization temperature (°C.) | aging period (minute) | mean particle size (μm) | particle size uniformity coefficiency (%) | 4 ms | 7 ms | 10 ms | 13 ms | 16 ms | resolution | occurence of missing dot | image uniformity |
| Example 1 | 1.08 | 70 | 50 | 2.50 | 92 | 0.16 | 0.58 | 1.11 | 1.78 | 2.11 | A | A | A |
| Example 2 | 1.20 | 70 | 60 | 3.50 | 93 | 0.16 | 0.57 | 1.13 | 1.77 | 2.11 | A | A | A |
| Example 3 | 1.55 | 80 | 50 | 3.00 | 90 | 0.17 | 0.57 | 1.12 | 1.78 | 2.11 | A | A | A |
| Example 4 | 1.55 | 70 | 90 | 4.00 | 94 | 0.16 | 0.59 | 1.12 | 1.78 | 2.11 | A | A | A |
| Example 5 | 1.80 | 70 | 240 | 8.90 | 87 | 0.15 | 0.55 | 1.11 | 1.76 | 2.10 | A | B | B |
| Example 6 | 1.20 | 80 | 45 | 3.90 | 93 | 0.17 | 0.58 | 1.14 | 1.77 | 2.10 | A | A | A |
| Example 7 | 1.08 | 85 | 40 | 2.90 | 91 | 0.17 | 0.57 | 1.14 | 1.80 | 2.11 | A | A | A |
| Example 8 | 0.75 | 60 | 90 | 1.80 | 95 | 0.18 | 0.60 | 1.15 | 1.81 | 2.12 | A | A | A |
| Example 9 | 1.72 | 60 | 240 | 3.20 | 95 | 0.18 | 0.57 | 1.14 | 1.80 | 2.11 | A | A | A |
| Example 10 | 1.05 | 60 | 120 | 2.10 | 94 | 0.16 | 0.59 | 1.13 | 1.79 | 2.11 | A | A | A |
| Example 11 | 2.89 | 80 | 240 | 20.00 | 85 | 0.09 | 0.50 | 1.01 | 1.71 | 2.05 | A | B | B |
| Example 12 | 0.48 | 60 | 120 | 0.20 | 89 | 0.08 | 0.52 | 1.05 | 1.72 | 2.03 | A | B | A |
| Comparative Example 1 | 8.00 | 80 | 240 | 50.00 | 80 | 0.08 | 0.34 | 0.81 | 1.39 | 1.75 | C | C | C |
| Comparative Example 2 | — | — | — | 0.08 | — | 0.08 | 0.37 | 0.85 | 1.37 | 1.78 | B | C | C |
| Comparative Example 3 | — | — | — | — | — | 0.09 | 0.58 | 1.10 | 1.72 | 1.95 | B | B | C |
| Comparative Example 4 | — | — | — | — | — | 0.06 | 0.21 | 0.69 | 1.27 | 1.69 | D | D | D |

*molar ratio of the positive charge-bearing resin/the negative charge-bearing resin

TABLE 2

| | thermoplastic resin fine particle aggregate | | | | | evaluation | | | | | | | |
|---|---|---|---|---|---|---|---|---|---|---|---|---|---|
| | | | | | | | | | | | image quality | | |
| | | | | | | optical density of image | | | | | | | |
| | molar ratio* | polymerization temperature (°C.) | aging period (minute) | mean particle size (μm) | particle size uniformity coefficiency (%) | 4 ms | 7 ms | 10 ms | 13 ms | 16 ms | resolution | occurence of missing dot | image uniformity |
| Example 13 | 1.08 | 70 | 50 | 2.50 | 92 | 0.17 | 0.58 | 1.13 | 1.80 | 2.12 | A | A | A |
| Example 14 | 1.20 | 70 | 60 | 3.50 | 93 | 0.16 | 0.57 | 1.12 | 1.78 | 2.11 | A | A | A |
| Example 15 | 1.55 | 80 | 50 | 3.00 | 90 | 0.16 | 0.58 | 1.12 | 1.78 | 2.12 | A | A | A |
| Example 16 | 1.55 | 70 | 90 | 4.00 | 94 | 0.17 | 0.59 | 1.13 | 1.80 | 2.12 | A | A | A |
| Example 17 | 1.80 | 70 | 240 | 8.90 | 87 | 0.15 | 0.56 | 1.12 | 1.78 | 2.11 | A | B | A |
| Example 18 | 1.20 | 80 | 45 | 3.90 | 93 | 0.17 | 0.59 | 1.14 | 1.79 | 2.12 | A | A | A |
| Example 19 | 1.08 | 85 | 40 | 2.90 | 91 | 0.17 | 0.59 | 1.13 | 1.80 | 2.12 | A | A | A |
| Example 20 | 0.75 | 60 | 90 | 1.80 | 95 | 0.16 | 0.57 | 1.12 | 1.79 | 2.12 | A | A | A |
| Example 21 | 1.72 | 60 | 240 | 3.20 | 95 | 0.15 | 0.56 | 1.11 | 1.77 | 2.10 | A | A | A |
| Example 22 | 1.05 | 60 | 120 | 2.10 | 94 | 0.16 | 0.58 | 1.12 | 1.79 | 2.12 | A | A | A |
| Example 23 | 2.89 | 80 | 240 | 20.00 | 85 | 0.14 | 0.55 | 1.10 | 1.78 | 2.11 | A | B | B |
| Example 24 | 0.48 | 60 | 120 | 0.20 | 89 | 0.13 | 0.52 | 1.10 | 1.74 | 2.11 | A | B | B |
| Comparative Example 5 | 8.00 | 80 | 240 | 50.00 | 80 | 0.09 | 0.38 | 1.01 | 1.60 | 2.01 | C | C | C |
| Comparative Example 6 | — | — | — | 0.08 | — | 0.12 | 0.37 | 1.05 | 1.70 | 2.10 | B | D | C |

*molar ratio of the positive charge-bearing resin/the negative charge-bearing resin

TABLE 3

| | molar ratio* | polymerization temperature (°C.) | aging period (minute) | mean particle size (μm) | particle size uniformity coefficiency (%) |
|---|---|---|---|---|---|
| Example 25 | 0.78 | 70 | 50 | 0.3 | 90 |
| Example 26 | 0.85 | 70 | 60 | 0.5 | 91 |
| Example 27 | 1.05 | 65 | 90 | 1.9 | 96 |
| Example 28 | 1.50 | 80 | 90 | 5.2 | 95 |
| Example 29 | 0.70 | 65 | 60 | 0.2 | 89 |

*molar ratio of the positive charge-bearing resin/the negative charge-bearing resin

TABLE 4

| | | evaluation | | | | | | | |
|---|---|---|---|---|---|---|---|---|---|
| | | optical density of image | | | | | image quality | | |
| | glossiness | 4 ms | 7 ms | 10 ms | 13 ms | 16 ms | resolution | occurence of missing dot | image uniformity |
| Example 25 | 23 | 0.16 | 0.58 | 1.12 | 1.78 | 2.11 | A | A | A |
| Example 26 | 18 | 0.16 | 0.59 | 1.12 | 1.78 | 2.12 | A | A | A |
| Example 27 | 15 | 0.17 | 0.59 | 1.13 | 1.80 | 2.12 | A | A | A |
| Example 28 | 12 | 0.15 | 0.57 | 1.12 | 1.80 | 2.12 | A | A | A |
| Example 29 | 30 | 0.16 | 0.58 | 1.11 | 1.77 | 2.11 | A | B | A |
| Comparative Example 6 | 25 | 0.11 | 0.42 | 0.99 | 1.58 | 1.99 | B | C | C |

What we claim is:

1. An image-receiving sheet in combination with a color transfer sheet said image-receiving sheet comprising a substrate and an image-receiving layer disposed on said substrate, wherein said image-receiving layer is formed of a composition comprising thermoplastic resin fine particle aggregates having a dye-receptive property and a binder.

2. An image-receiving sheet for thermal transfer printing according to claim 1, wherein the thermoplastic resin fine particle aggregates contain polycondensation resin and/or polyaddition resin as their constituent.

3. An image-receiving sheet for thermal transfer printing according to claim 2, wherein the thermoplastic resin fine particle aggregates further contain vinyl polymer resin as their constituent.

4. An image-receiving sheet for thermal transfer printing according to claim 3, wherein the thermoplastic resin fine particle aggregates are aggregates obtained by polymerizing polyester resin having a sulfonate group with vinyl monomer having an cationic group.

5. An image-receiving sheet for thermal transfer printing according to claim 2, wherein the polycondensation resin is polyester resin.

6. An image-receiving sheet for thermal transfer printing according to claim 1, wherein the thermoplastic resin fine particle aggregates are of a mean particle size in the range of from 0.1 to 40 μm.

7. An image-receiving sheet for thermal transfer printing according to claim 6, wherein the thermoplastic resin fine particle aggregates are of a mean particle size in the range of from 0.2 to 20 μm.

8. An image-receiving sheet for use in combination with a colorant transfer sheet in thermal transfer printing, said image-receiving sheet comprising a substrate and an image-receiving layer disposed on said substrate, wherein said image-receiving layer has a multi-layered structure comprising a dye-receptive undercoat layer and a layer containing thermoplastic resin fine particle aggregates, an aqueous releasing agent and an aqueous cross-linking agent.

9. An image-receiving sheet for thermal transfer printing according to claim 8, wherein the thermoplastic resin fine particle aggregates contain polycondensation resin and/or polyaddition resin as their constituent.

10. An image-receiving sheet for thermal transfer printing according to claim 9, wherein the thermoplastic resin fine particle aggregates further contain vinyl polymer resin as their constituent.

11. An image-receiving sheet for thermal transfer printing according to claim 10, wherein the thermoplastic resin fine particle aggregates are aggregates obtained by polymerizing polyester resin having a sulfonate group with vinyl monomer having an cationic group.

12. An image-receiving sheet for thermal transfer printing according to claim 9, wherein the polycondensation resin is polyester resin.

13. An image-receiving sheet for thermal transfer printing according to claim 8, wherein the thermoplastic resin fine particle aggregates are of a mean particle size in the range of from 0.1 to 15 μm.

14. An image-receiving sheet for use in combination with a colorant transfer sheet in thermal transfer printing, said image-receiving sheet comprising a substrate, an intermediate layer disposed on said substrate, and an image-receiving layer disposed on said intermediate layer, wherein at least said intermediate layer contains thermoplastic resin fine particle aggregates.

15. An image-receiving sheet for thermal transfer printing according to claim 14, wherein the thermoplastic resin fine particle aggregates contain polycondensation resin and/or polyaddition resin as their constituent.

16. An image-receiving sheet for thermal transfer printing according to claim 15, wherein the thermoplastic resin fine particle aggregates further contain vinyl polymer resin as their constituent.

17. An image-receiving sheet for thermal transfer printing according to claim 16, wherein the thermoplastic resin fine particle aggregates are aggregates obtained by polymerizing polyester resin having a sulfonate group with vinyl monomer having an cationic group.

18. An image-receiving sheet for thermal transfer printing according to claim 15, wherein the polycondensation resin is polyester resin.

19. An image-receiving sheet for thermal transfer printing according to claim 14, wherein the thermoplastic resin fine particle aggregates are of a mean particle size in the range of from 0.1 to 40 μm.

20. An image-receiving sheet for thermal transfer printing according to claim 19, wherein the thermoplastic resin fine particle aggregates are of a mean particle size in the range of from 0.2 to 20 μm.

* * * * *